US009874346B2

(12) United States Patent
Weitzel

(10) Patent No.: US 9,874,346 B2
(45) Date of Patent: Jan. 23, 2018

(54) ADVANCED ULTRA SUPERCRITICAL STEAM GENERATOR

(71) Applicant: Babcock & Wilcox Power Generation Group, Inc., Barberton, OH (US)

(72) Inventor: Paul S Weitzel, Canal Fulton, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 748 days.

(21) Appl. No.: 14/044,900

(22) Filed: Oct. 3, 2013

(65) Prior Publication Data

US 2015/0096507 A1 Apr. 9, 2015

(51) Int. Cl.

| | |
|---|---|
| ***F22B 21/34*** | (2006.01) |
| ***F23B 30/00*** | (2006.01) |
| ***F22B 29/06*** | (2006.01) |
| ***F22B 35/00*** | (2006.01) |
| ***F22B 37/14*** | (2006.01) |
| ***F22G 5/06*** | (2006.01) |

(52) U.S. Cl.

CPC ..... *F23B 7/005* (2013.01); *F22B 21/348* (2013.01); *F22B 29/067* (2013.01); *F22B 35/002* (2013.01); *F22B 37/146* (2013.01); *F22G 5/06* (2013.01); *F23B 7/007* (2013.01)

(58) Field of Classification Search

CPC ..... F22B 21/34; F22B 29/067

See application file for complete search history.

(56) References Cited

U.S. PATENT DOCUMENTS 2,982,266 A * 5/1961 Rowand ..... F22B 1/22 122/478
3,040,719 A * 6/1962 Dickey ..... F22B 35/002 122/479.1
3,161,180 A * 12/1964 Durham ..... F22G 5/04 122/479.1
3,192,909 A * 7/1965 Richardson ..... F22G 5/06 122/478
3,205,870 A * 9/1965 Durham ..... F22G 5/04 122/479.5
3,245,385 A * 4/1966 Koch ..... F22B 29/06 122/406.1
3,324,837 A * 6/1967 Gorzegno ..... F22G 5/04 122/406.4
3,368,534 A * 2/1968 Gorzegno ..... F22G 5/04 122/480
3,580,226 A * 5/1971 Blackburn, Jr. ..... F16B 39/30 110/171

(Continued)

*Primary Examiner* — Gregory A Wilson
(74) *Attorney, Agent, or Firm* — Michael J. Seymour

(57) ABSTRACT

A supercritical steam generator includes a downdraft furnace enclosure, a hopper tunnel, and a convection pass enclosure, with the hopper tunnel joining the downdraft furnace enclosure and convection pass enclosure together. Flue gas passes down through the downdraft furnace enclosure through the hopper tunnel and up through the convection pass enclosure. This structure permits the outlet steam terminals, which provide access to the resultant supercritical steam and/or reheat steam, to be located at a base of the steam generator rather than at the top of the steam generator as with conventional boilers. This reduces the length of the steam leads from the steam generator to a steam turbine that produces electricity using the supercritical steam.

19 Claims, 17 Drawing Sheets

(56) References Cited

U.S. PATENT DOCUMENTS 3,665,893 A * 5/1972 Barberton ..... F22B 37/66 122/510
3,927,627 A * 12/1975 Brunn ..... F23L 15/00 110/342
4,398,504 A * 8/1983 Kwasnik, Jr. ..... F22B 1/1846 122/467
4,442,795 A * 4/1984 Strohmeyer, Jr. ... F22B 31/0007 110/245
4,442,797 A * 4/1984 Strohmeyer, Jr. ..... B01J 8/388 110/245
4,462,341 A * 7/1984 Strohmeyer, Jr. ..... F23C 10/02 110/263
4,479,355 A * 10/1984 Guide ..... F01K 23/06 60/655
4,493,291 A * 1/1985 Zabelka ..... C10J 3/86 122/5
4,494,468 A * 1/1985 Rickard ..... F23C 9/08 110/171
4,709,662 A * 12/1987 Rawdon ..... B01J 8/388 110/245
4,709,663 A * 12/1987 Larson ..... B01J 8/388 110/245
4,745,884 A * 5/1988 Coulthard ..... B01J 8/1836 110/245
5,237,963 A * 8/1993 Garcia-Mallol .... F22B 31/0084 110/210
5,343,830 A * 9/1994 Alexander ..... F22B 31/0084 110/245
5,967,098 A * 10/1999 Tanca ..... F22B 31/0038 110/245
6,058,858 A * 5/2000 Belin ..... F22B 31/0084 110/204
6,071,482 A * 6/2000 Brockerhoff ..... G21C 9/00 376/281
6,325,001 B1 * 12/2001 Sheldon ..... F22B 31/00 110/224
9,488,370 B2 * 11/2016 Jiang ..... F23C 3/00
2005/0070751 A1 * 3/2005 Capote ..... F23G 7/001 588/311
2006/0089519 A1 * 4/2006 Stell ..... C10G 9/00 585/648
2006/0107587 A1 * 5/2006 Bullinger ..... C10L 9/08 44/629
2016/0146452 A1 * 5/2016 Wang ..... F23C 10/08 110/245

* cited by examiner

ADVANCED ULTRA SUPERCRITICAL STEAM GENERATOR

BACKGROUND

The present disclosure relates to steam generating systems which can be used in combination with carbon capture sequestration (CCS) technology for use in coal-fired power generation.

During combustion, the chemical energy in a fuel is converted to thermal heat inside the furnace of a boiler. The thermal heat is captured through heat-absorbing surfaces in the boiler to produce steam. The fuels used in the furnace include a wide range of solid, liquid, and gaseous substances, including coal, natural gas, and diesel oil. Combustion transforms the fuel into a large number of chemical compounds. Water and carbon dioxide ($CO_2$) are the products of complete combustion. Incomplete combustion reactions may result in undesirable byproducts that can include particulates (e.g. fly ash, slag), acid gases such as SOx or NOx, metals such as mercury or arsenic, carbon monoxide (CO), and hydrocarbons (HC).

FIG. 1 illustrates the steam-water flow system and the gas flow system for a conventional once-through two pass Carolina-style boiler 10 with a furnace 20 capable of operating at subcritical to supercritical pressure. As is known, the boiler 10 includes fluid cooled membrane tube enclosure walls typically made up of water/steam conveying tubes 30 separated from one another by a steel membrane (not visible) to achieve a gas-tight enclosure. The tubes 30 are referred to herein as water tubes for brevity and simplicity.

The steam generator operates with a variable pressure profile versus load (subcritical to supercritical pressure). The water enters the economizer through inlet 141 and absorbs heat, then travels from economizer outlet 142 to inlet 143 at the base of the furnace. A lower bottle (not shown) may be present to distribute this water. The water then travels up through the furnace wall tubes 30. As the water travels through these water tubes 30, the water cools the tubes exposed to high-temperature flue gas in the combustion chamber 60 and absorbs energy from the flue gas to become a steam-water mixture at subcritical pressure (and remains a single phase fluid if at supercritical pressure conditions). The fluid is discharged into the vertical steam separators 42, where the steam-water mixture is separated, when subcritical, into wet steam (i.e., saturated steam) and water. Any water can exit via downcomer 50 and pass from outlet 144 to the economizer inlet 141. When the fluid is supercritical, the vertical separators act as conveying pipes with all the entering steam leaving from the top outlets. The steam is used to cool the flue gas in the convection pass path 70 of the furnace through steam tubes or roof tubes 75 leading from the vertical separator. The steam then passes from outlet 149 to inlet 145 and is fed through superheater heating surface 80, then sent to the high pressure steam turbine (reference number 146). Steam returning from the high pressure steam turbine (reference number 147) passes through the reheater heating surface 90 to absorbing additional energy from the flue gas, and can then be sent to a second intermediate-pressure or low-pressure steam turbine (reference number 148). The steam sent to the turbines is generally dry steam (100% steam, no water). The steam from the superheater 80 heating surfaces can be sent to a high pressure (HP) turbine, then from the reheater 90 heating surface to the intermediate pressure (IP) and low pressure (LP) steam turbine stages (not shown). Feedwater conveyed through economizer 100 may also be used to absorb energy from the flue gas before the flue gas exits the boiler; the heated feedwater is then sent to the furnace enclosure tubes 30, or can be sent through superheater 80 and reheater 90.

Referring to the gas flow system, air for combustion can be supplied to the furnace 20 through several means. Typically, a fan 102 supplies air 104 to a regenerative air heater 106. The heated air is then sent as secondary air 108 to windboxes for distribution to individual burners and as primary air 110 to the coal pulverizer 112, where coal is dried and pulverized. The primary air (now carrying coal particles) 116 is then sent to the burners 120 and mixed with the secondary air 108 for combustion and formation of flue gas 130 in the combustion chamber 60. The flue gas flows upwardly through the furnace combustion chamber 60 and then follows the convection pass path 70 to flue gas exhaust 160 past superheater 80, reheater 90, and economizer 100. The flue gas can then be passed through the regenerative air heater 106 (to heat the incoming air 104) and pollution control equipment 114 and, if desired, recycled through the furnace 20. The flue gas exits the boiler 10 through the flue gas exhaust 160.

FIG. 1 also illustrates the start up equipment of the steam-water flow system. When the steam is supercritical, a vertical steam separator 42 is used instead of a conventional horizontal steam drum of a subcritical natural circulation boiler. A boiler circulation pump 44 and shutoff valve 46 are also present in the downcomer 50 to augment the flow in the furnace enclosure wall water tubes 30 and the economizer 100 during startup. The boiler circulation pump is stopped at the load where 100% dry steam is entering the vertical steam separator from the furnace enclosure. The vertical steam separator remains in service and a static column of water remains in the downcomer 50.

As illustrated here, the steam outlet terminals of a Carolina style boiler are located at the top of the boiler, generally at a relatively high elevation from grade of about 200 feet. The steam is then carried to a steam turbine via steam leads (i.e. pipes). The steam leads are made from a nickel alloy for 700° C. steam temperatures, which is very expensive. Due to the location of the steam outlet terminals at the top of the boiler, the length of the steam leads can be very great. It would be desirable to be able to reduce the length of the steam leads from the steam outlet terminals of the boiler to the steam turbine where the steam is used to generate electricity.

BRIEF DESCRIPTION

The present disclosure relates to a boiler system which can be used in conjunction with a steam turbine to generate electricity. The steam outlet terminals of the boiler are located at the base of the boiler, instead of at the top of the boiler. This reduces the needed length of the steam leads, in turn reducing the cost and improving the economics of the overall system.

Disclosed in various embodiments herein is a steam generator, comprising: a downdraft furnace enclosure formed from walls made of water or steam cooled tubes, and wherein the furnace walls define a top end and a bottom gas outlet; a convection pass enclosure including a bottom gas inlet and horizontal tube banks located above the bottom gas inlet; a hopper tunnel connecting the bottom gas outlet of the downdraft furnace enclosure to the bottom gas inlet of the convection pass enclosure; and a steam outlet terminal located at the base of the steam generator.

The bottom gas outlet of the downdraft furnace enclosure may include an outwardly-extending throat that extends into a porthole of the bottom gas inlet of the convection pass enclosure.

The top end of the downdraft furnace enclosure may include a gas inlet for receiving flue gas from an associated furnace.

The steam generator may further comprise a windbox and burners at the top end of the downdraft furnace enclosure for generating flue gas.

The flue gas exiting the convection pass enclosure may be recirculated to the top end of the downdraft furnace enclosure, to a base of the downdraft furnace enclosure, and/or to a base of the convection pass enclosure.

The flue gas exiting the convection pass enclosure may pass through a particulate cleaning device and then be recirculated to the top end of the downdraft furnace enclosure, a base of the downdraft furnace enclosure, or a base of the convection pass enclosure.

The hopper tunnel may be lined with a refractory material. The hopper tunnel can include a submerged chain conveyor for removing ash and slag. The submerged chain conveyor may travel in-line with the flue gas flow, or may travel transverse to the flue gas flow.

Alternatively, the hopper tunnel can be formed from steam or water-cooled tube panels. Water trough seals may be present between the downdraft furnace enclosure, the hopper tunnel, and the convection pass enclosure.

The fluid in the tubes of the downdraft furnace enclosure can flow counter-current to flue gas flow.

The convection pass enclosure is sometimes formed from enclosure walls made of steam or water cooled tubes, wherein the cooling fluid in the tubes of the convection pass enclosure flow co-current to flue gas flow.

The horizontal tube banks in the convection pass enclosure may include superheaters, reheaters, and economizers.

The steam generator may further comprise an upper horizontal pass enclosure connected to a top end of the convection pass enclosure and a down pass, the upper horizontal pass and the down pass containing additional tube banks.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
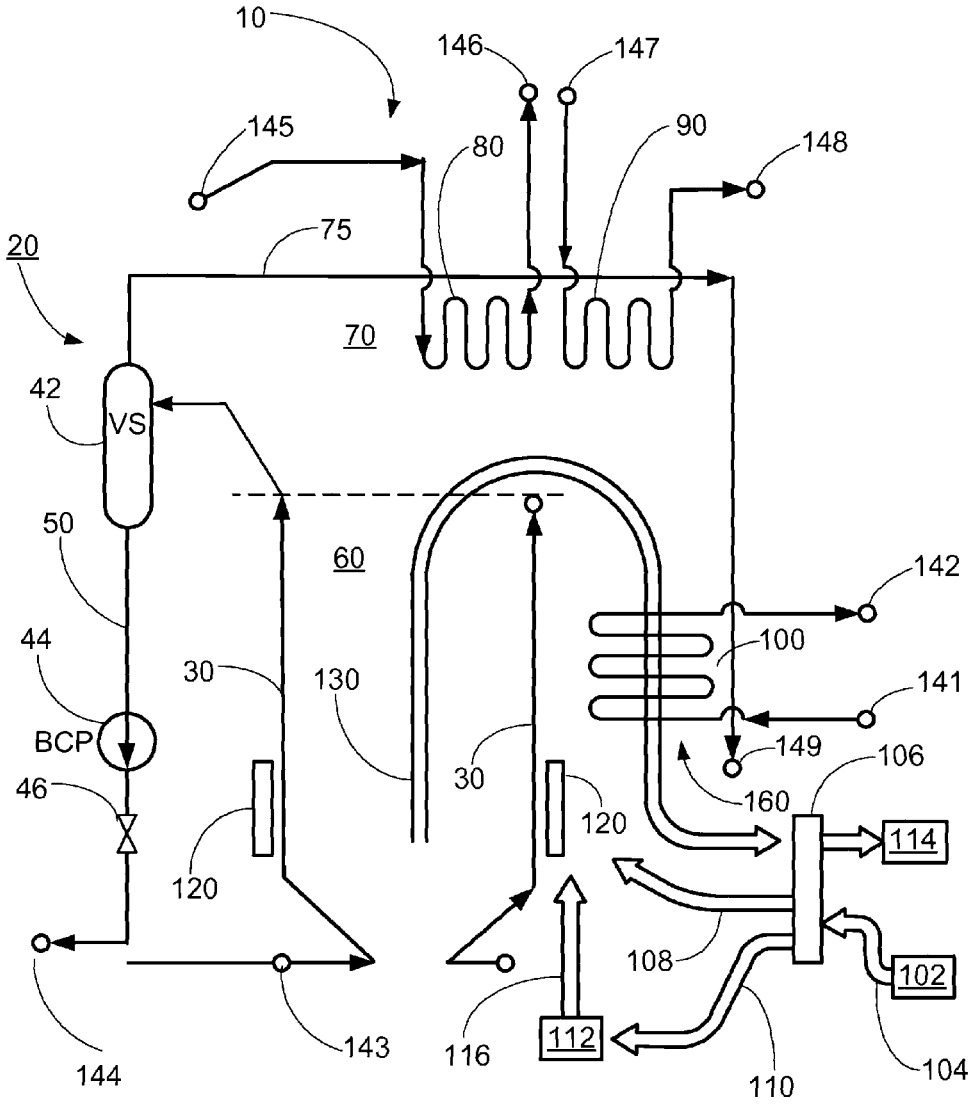
FIG. 1 PRIOR ART
FIG. 1 is a schematic diagram illustrating a conventional two-pass (Babcock and Wilcox Carolina-style) subcritical or supercritical once through type steam generator

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of."

Numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 watts to 10 watts" is inclusive of the endpoints, 2 watts and 10 watts, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

The terms "waterside", "water cooled", "steam cooled" or "fluid side" refer to any area of the boiler that is exposed to water or steam. In contrast, the terms "airside", "gas side" or "fireside" refer to an area of the boiler that is exposed to direct heat from the furnace, or in other words the combustion gas from the furnace. Where the specification refers to water and/or steam, the liquid and/or gaseous states of other fluids may also be used in the methods of the present disclosure.

It should be noted that many of the terms used herein are relative terms. For example, the terms "upper" and "lower" are relative to each other in location, i.e. an upper component is located at a higher elevation than a lower component in a given orientation. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow fluids through an upstream component prior to flowing through the downstream component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" and "bottom" or "base" are used to refer to surfaces where the top is always higher than the bottom/base relative to an absolute reference, i.e. the surface of the earth. The terms "above" and "below" are used to refer to the location of two structures relative to an absolute reference. For example, when the first component is located above a second component, this means the first component will always be higher than the second component relative to the surface of the earth. The terms "upwards" and "downwards" are also relative to an absolute reference; an upwards flow is always against the gravity of the earth.

As used herein, the term "supercritical" refers to a fluid that is at a temperature above its critical temperature or at a pressure above its critical pressure or both. For example, the critical temperature of water is 374.15° C., and the critical pressure of water is 3200.1 psia (22.1 MPa). A fluid at a temperature that is above its boiling point at a given pressure but is below its critical pressure is considered to be "superheated" but "subcritical". A superheated fluid can be cooled (i.e. transfer energy) without changing its phase. As used herein, the term "wet steam" refers to a saturated steam/water mixture (i.e., steam with less than 100% quality where quality is percent steam content by mass). As used herein, the term "dry steam" refers to steam having a quality equal to greater than 100% (i.e., no liquid water is present). Supercritical water or steam will have no visible bubble interface or meniscus forming during a heating or cooling process due to zero surface tension on reaching the critical point temperature. The fluid continues to act like a single phase flow while converting from water to steam or steam to water, and is a non-equilibrium thermodynamic condition where rapid changes in density, viscosity and thermal conductivity can occur.

To the extent that explanations of certain terminology or principles of the solar receiver, boiler and/or steam generator arts may be necessary to understand the present disclosure, the reader is referred to *Steam/its generation and use,* 40th Edition, Stultz and Kitto, Eds., Copyright 1992, The Babcock & Wilcox Company, and to *Steam/its generation and use,* 41st Edition, Kitto and Stultz, Eds., Copyright 2005, The Babcock & Wilcox Company, the texts of which are hereby incorporated by reference as though fully set forth herein.

In the conventional boiler of FIG. 1, the steam outlet terminals are at the top center of the structure. The top of the structure is relatively high, about 200 to 250 feet. Such a height is necessary for the furnace to have a volume sufficient for the coal particles to be completely combusted, for the water tubes to absorb the heat energy, and to lower the flue gas temperature below the ash fusion temperature (minimizing slagging and fouling in the various tube banks). It is desirable to also lower the height of the steam outlet terminals, so as to bring them closer to the steam turbine and offer a shorter overall setting height. The present disclosure relates to such a steam generator written. In particular, the steam generator of the present disclosure is an advanced ultra supercritical steam generator, which can produce an outlet steam pressure of 25 MPa (3625 psia) or higher, including 29 MPa (4200 psia) or higher; and an outlet steam temperature of 570° C. (1058° F.) or higher, including 730° C. (1346° F.) or higher. Unlike the natural circulation drum boiler where the furnace enclosure walls operate at nearly uniform temperatures close to saturation temperature, the advanced ultra supercritical once through steam generator of the present disclosure does not have fairly uniform enclosure wall temperatures near saturation. The conventional once through supercritical steam generator must be carefully designed to have fairly narrow differences and very similar geometry, thermo hydraulic flow characteristics and heat absorption conditions on all of the welded enclosure wall tubes. The present design thus permits the joining of a series of separate enclosures along the gas flow path which can operate at different material temperatures.

In the Carolina (two-pass) boiler of FIG. 1, the flue gas flows upwards, then horizontally and downwards through the tube banks. In the steam generators of the present disclosure, this gas flow path is reversed. The flue gas first flows downwards, then horizontally and then upwards through tube banks that convert the water to superheated or supercritical steam. This arrangement allows the steam terminals to be lower (closer to the ground) and closer to the steam turbine.

Figure 2:
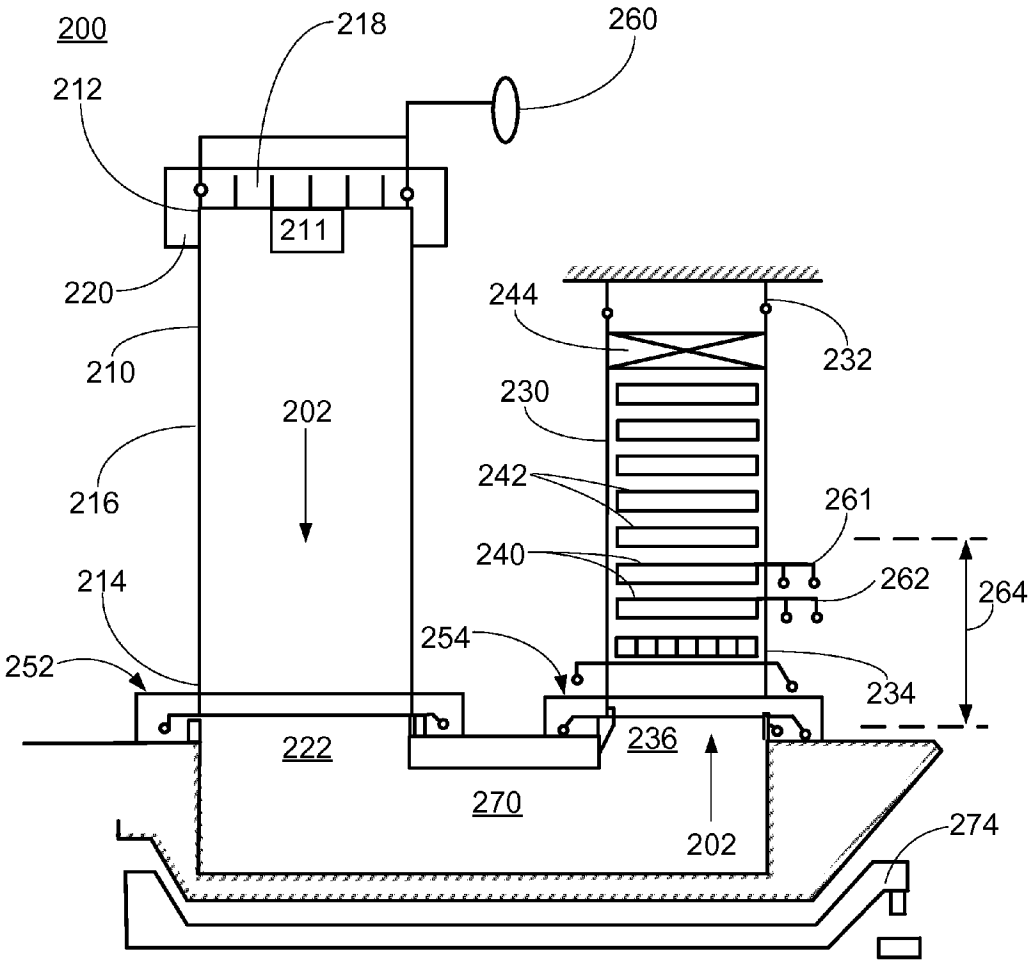
FIG. 2 is a side perspective view of a first exemplary embodiment of a once through steam generator of the present disclosure, wherein the inverted tower downdraft furnace enclosure includes the burners that generate the flue gas.

FIG. 2 is a side perspective view of a first exemplary embodiment of a steam generator 200 of the present disclosure. The steam generator generally includes three structures: a downdraft furnace enclosure 210, a hopper tunnel 270, and a convection pass enclosure 230. The downdraft furnace enclosure is shown here on the left. The downdraft furnace enclosure 210 is formed from walls 216 made of water or steam cooled tubes, which may be arranged vertically or spirally. The furnace enclosure walls 216 define a top end 212 and a bottom end 214. The top end and the bottom end are at opposite ends of the furnace walls. As illustrated here, a windbox 218 and burners 220 are located near the top end of the furnace. The burners may be arranged in the roof (i.e. the top end) or at the top of the furnace walls. Burners may be located on all four walls, opposed on two of the walls, or near the corners of the four walls. The top end 212 of the downdraft furnace enclosure 210 may include a gas inlet 211 for receiving flue gas.

In use, air and coal are fed into the top end 212 by the windbox or roof vestibule 218, and combusted using the burners 220 to generate hot flue gas 202. Oxy-combustion (i.e. using oxygen-enriched recirculated gas) or air firing can be used. The windbox also generates an air flow that causes the flue gas to flow downwards due to mechanical draft fans (rather than rising as would naturally occur; the downdraft is aided by the wall cooling the flue gas). A bottom gas outlet 222 is present at the bottom end 214, through which the hot flue gas exits the furnace enclosure 210. The flue gas flows through a hopper tunnel 270 located at the base of the furnace enclosure. The hopper tunnel 270 fluidly connects the bottom gas outlet 222 of the downdraft furnace enclosure with a bottom gas inlet 236 of the convection pass enclosure. The hopper tunnel also flexibly seals the bottom gas outlet and the bottom gas inlet. When exiting the downdraft furnace enclosure, the flue gas may have a temperature of about 500° F. to about 2500° F. The flue gas 202 then flows upwards through the convection pass enclosure 230 past horizontally arranged tube banks that act as superheater 240, reheater 242, and/or economizer 244 surfaces. These surfaces capture additional energy from the flue gas. When exiting the convection pass enclosure, the flue gas may have a temperature of about 240° F. to about 825° F. The convection pass enclosure 230 itself also has a top end 232 and a bottom end 234.

The flue gas may pass through a regenerative air heater 302 to transfer some of the remaining heat energy to incoming air. The flue gas may also be sent to pollution control units to remove undesired byproducts. For example, the flue gas can pass through a selective catalytic reduction (SCR) unit 300 to remove NOx, a flue gas desulfurization (FGD) unit 304 to remove SOx, and/or a particulate cleaning device 306 (e.g. a baghouse or electrostatic precipitator). The pollution control units and the regenerative air heater are placed in an order suitable for optimum pollution reduction. For example, in specific embodiments, the SCR unit 300 is placed upstream of the regenerative air heater 302. If desired, the flue gas exiting the convection pass enclosure may be recirculated to the windbox or vestibule 218 at the top of the furnace enclosure, a practice generally referred to as gas recirculation (reference numeral 310). If desired, the flue gas exiting the convection pass enclosure can also be recirculated to the base 252 of the downdraft furnace enclosure for steam temperature control (reference numeral 312) and/or to the base 254 of the convection pass enclosure (reference numeral 314) and used to control the flue gas temperature, which is generally referred to as gas tempering. The steam generator may include any of these recirculation paths, or may include all three recirculation paths.

With regard to the fluid flow in the downdraft furnace enclosure, relatively cold water from the economizer outlet enters the steam generator at the base of the furnace walls 216, and flows through the water tubes, becoming a steam/water mixture by absorbing the heat energy in the flue gas. This water flows counter-current to the flue gas flow (i.e. the water flows upwards while the flue gas flows downwards). The steam/water mixture is collected in outlet headers and sent to vertical steam separators 260 and separated into wet steam and water. The steam is sent to the convection pass enclosure 230 through the superheater 240 then to the steam turbine, and then returns from the steam turbine to pass through the reheater 242 tube banks in the convection pass enclosure. In some embodiments, the convection pass enclosure is also formed from enclosure walls made of water or steam cooled tubes, which can also capture energy. In such embodiments, the fluid flow in the enclosure walls of the convection pass enclosure is co-current to the flue gas flow (i.e. both flow upwards). Generally, the downdraft furnace enclosure is water-cooled at lower loads and becomes steam cooled near the outlet at higher loads, while the convection pass enclosure is steam-cooled.

The supercritical steam and/or reheat steam exits at one or more steam outlet terminals located at the base 254 of the convection pass enclosure, which is part of the steam generator. The reheat steam outlet terminal is labeled with reference numeral 261, while the supercritical steam outlet terminal is labeled with reference number 262, and either or both of these outlet terminals may be present. The term "base" refers here to the bottom one-third of the steam generator's height, the height being indicated by reference numeral 264. For example, if the steam generator has a height of about 60 feet, then the steam outlet terminal(s) is at a height of at about 20 feet. It should be recognized that the furnace enclosure and the convection pass enclosure may be of different heights.

In this regard, the steam leads for main steam and hot reheat piping needed to operate an advanced ultra supercritical steam generator at 700° C. (1292° F.) are as much as four (4) times the cost of material by mass for the steam leads needed to operate a steam generator at 600° C. (1112° F.). It can thus be advantageous to use the present design to lower the steam outlet terminal rather than incur the cost of such piping.

The tube banks in the convection pass enclosure should be drainable. Internal deposits are generally dispersed along the tube rows, so as not to concentrate in the lower bends of pendant sections. At the connection to the enclosure walls, expansion water seals or gas tight expansion joints (not shown) are present between the enclosure walls and the tube banks.

Returning to FIG. 2, the hopper tunnel 270 flexibly connects the downdraft furnace enclosure 210 to the convection pass enclosure 230. The hopper tunnel is desirably adiabatic. The hopper tunnel 270 includes one or more ash and slag outlets connected to submerged chain conveyor(s) 274. It is contemplated that ash and slag fall into the submerged chain conveyor(s) and are disposed of. The chain conveyor can either be in-line with the flue gas flow, or can be transverse to the flue gas flow. As illustrated here, the chain conveyor is in-line.

Figure 3:
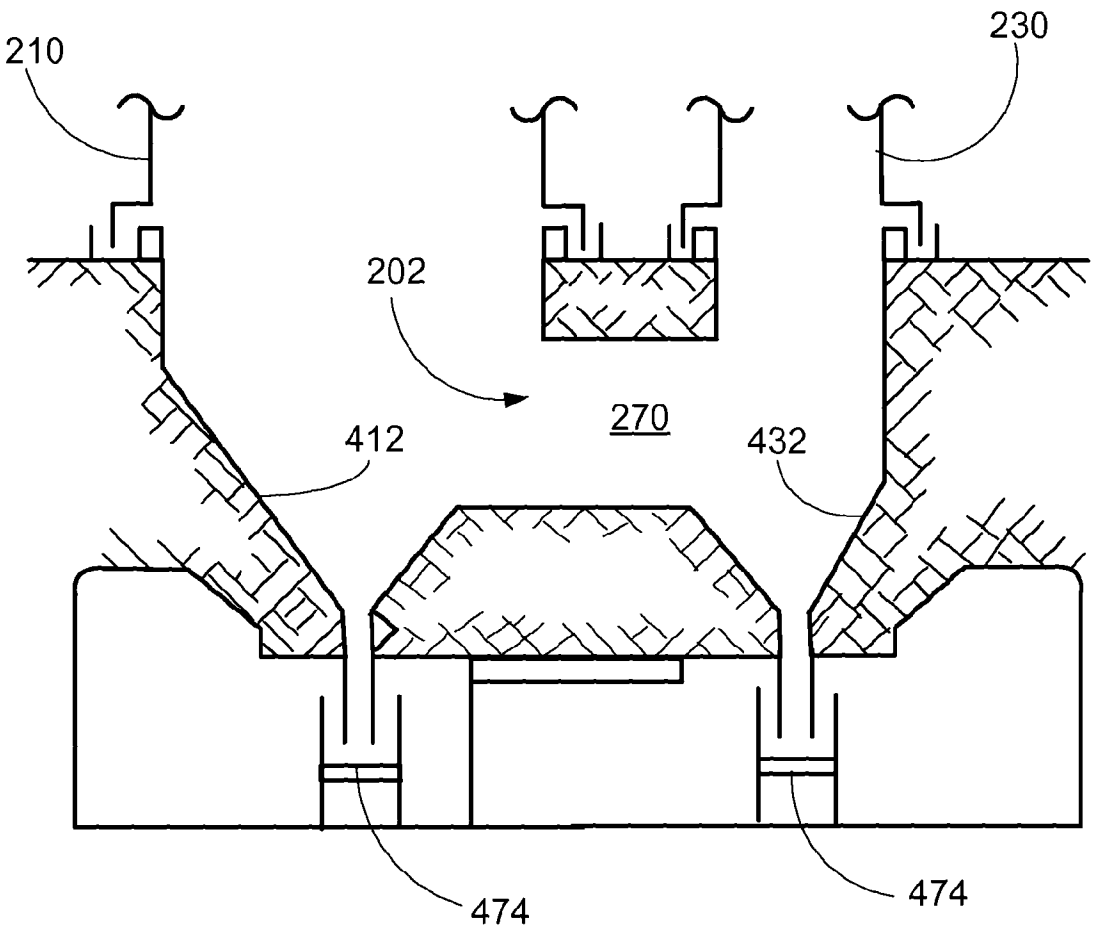
FIG. 3 is a cross-sectional view of one possible design for the hopper tunnel, with conveyors traveling transverse to the flue gas flow. The hopper tunnel is an in-ground refractory lined, concrete and steel arch way to transfer the flue gas flow.

FIG. 3 is an alternative embodiment of the hopper tunnel 270, in which the chain conveyors are transverse to the flue gas flow 202. Two submerged chain conveyors 474 are visible in the hopper tunnel 270 under the downdraft furnace enclosure 210 and the convection pass enclosure 230. As seen here, one difference is that the base 412 of the downdraft furnace enclosure and the base 432 of the convection pass enclosure are sloped to guide the ash/slag into the submerged chain conveyors.

Figure 4:
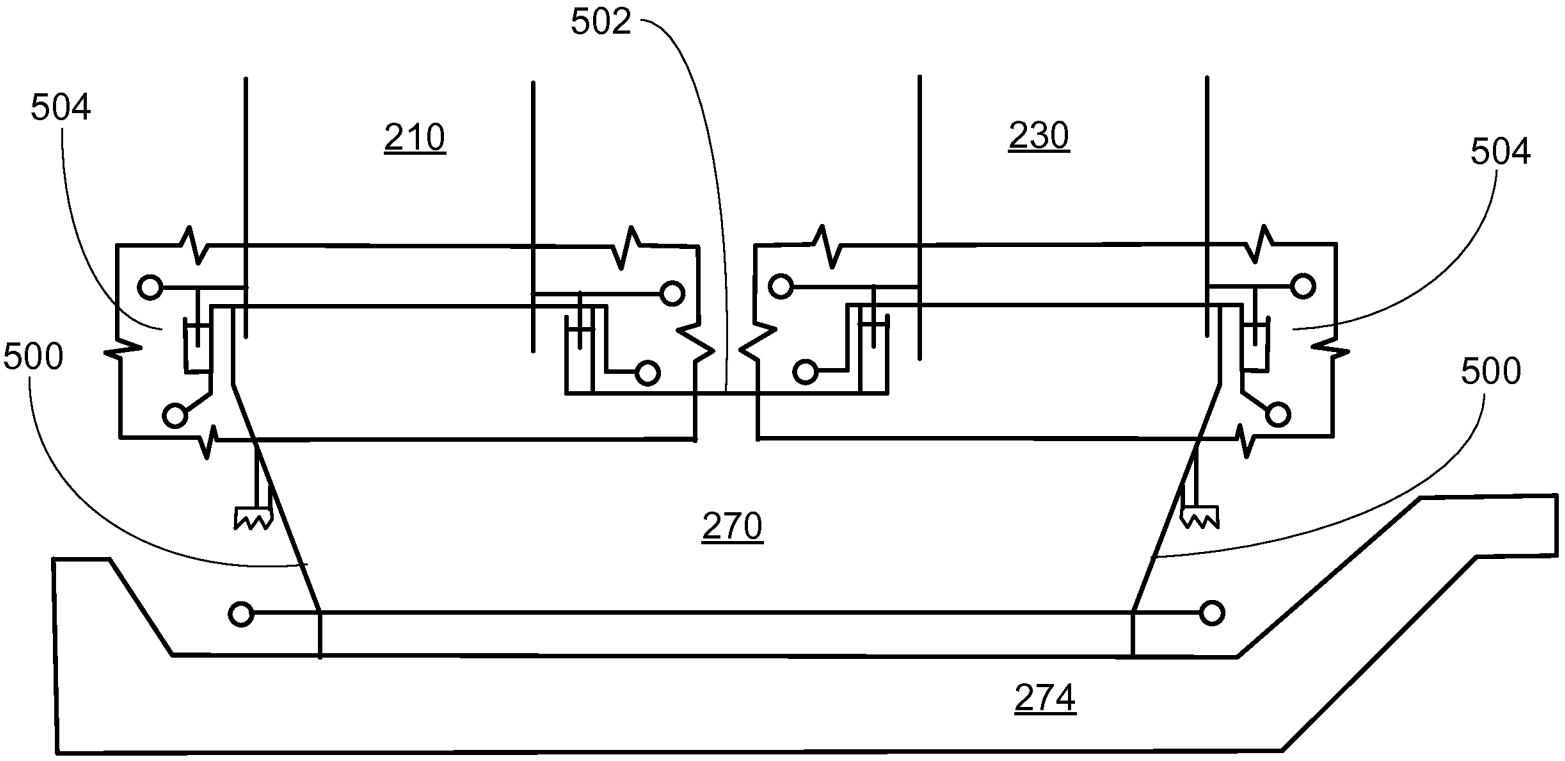
FIG. 4 is another embodiment of the hopper tunnel, being formed from steam or water-cooled tube panels.

FIG. 4 is another embodiment of the hopper tunnel. Here, the hopper tunnel is also formed from steam or water-cooled tube panels. The tube panels 500 forming the sides of the hopper tunnel are bottom-supported, while the roof 502 of the hopper tunnel is top-supported using the side walls of the hopper tunnel. Water trough seals or nonmetallic seals 504 can be made between the hopper tunnel 270, the downdraft furnace enclosure 210, and the convection pass enclosure 230. The chain conveyor 274 is illustrated as forming the closure of the hopper tunnel.

Figure 5:
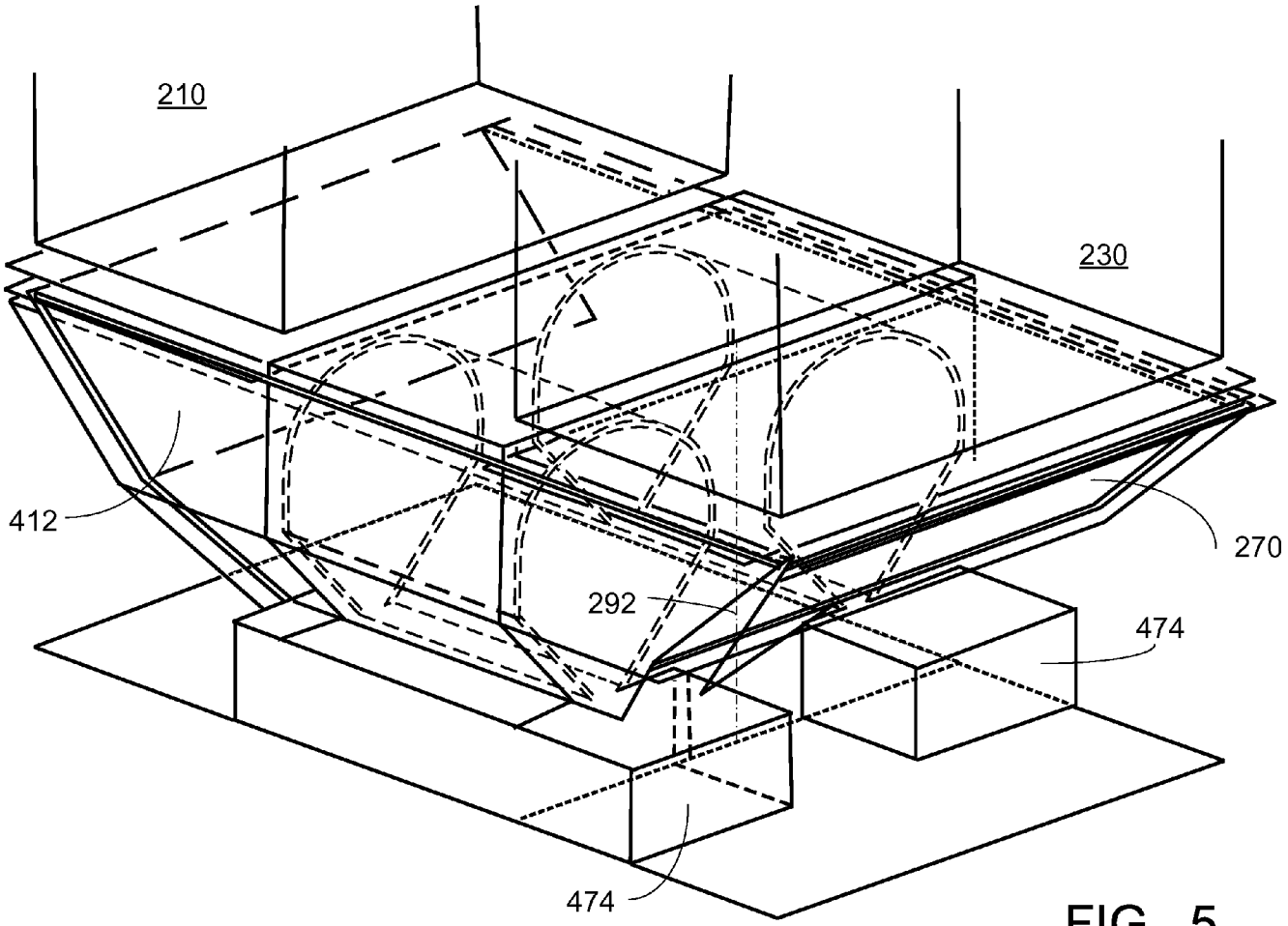
FIG. 5 is a perspective view showing a variation of the hopper tunnel having a vertical wall.
Figure 6:
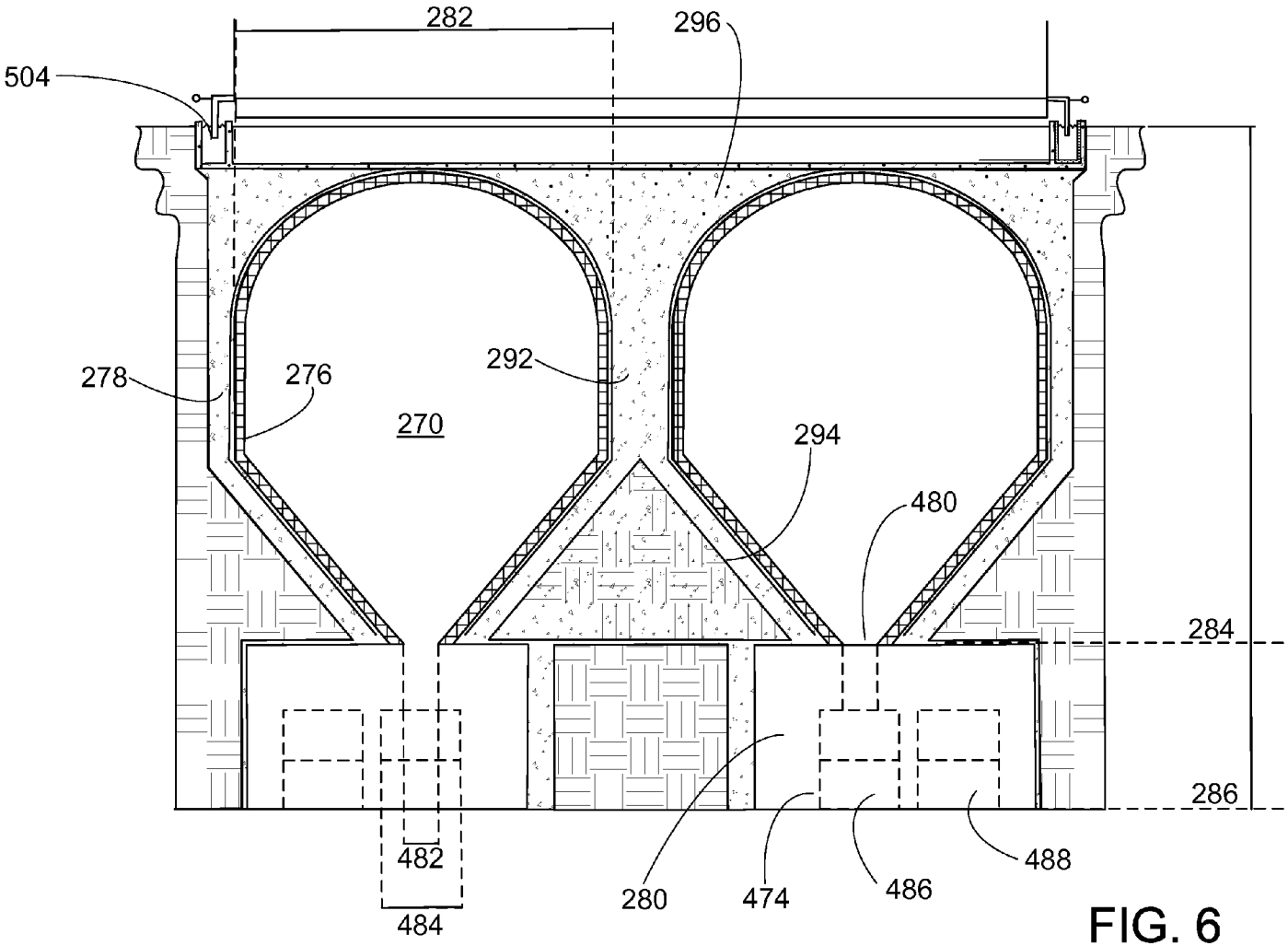
FIG. 6 is a front view of the hopper tunnel of FIG. 5.
Figure 7:
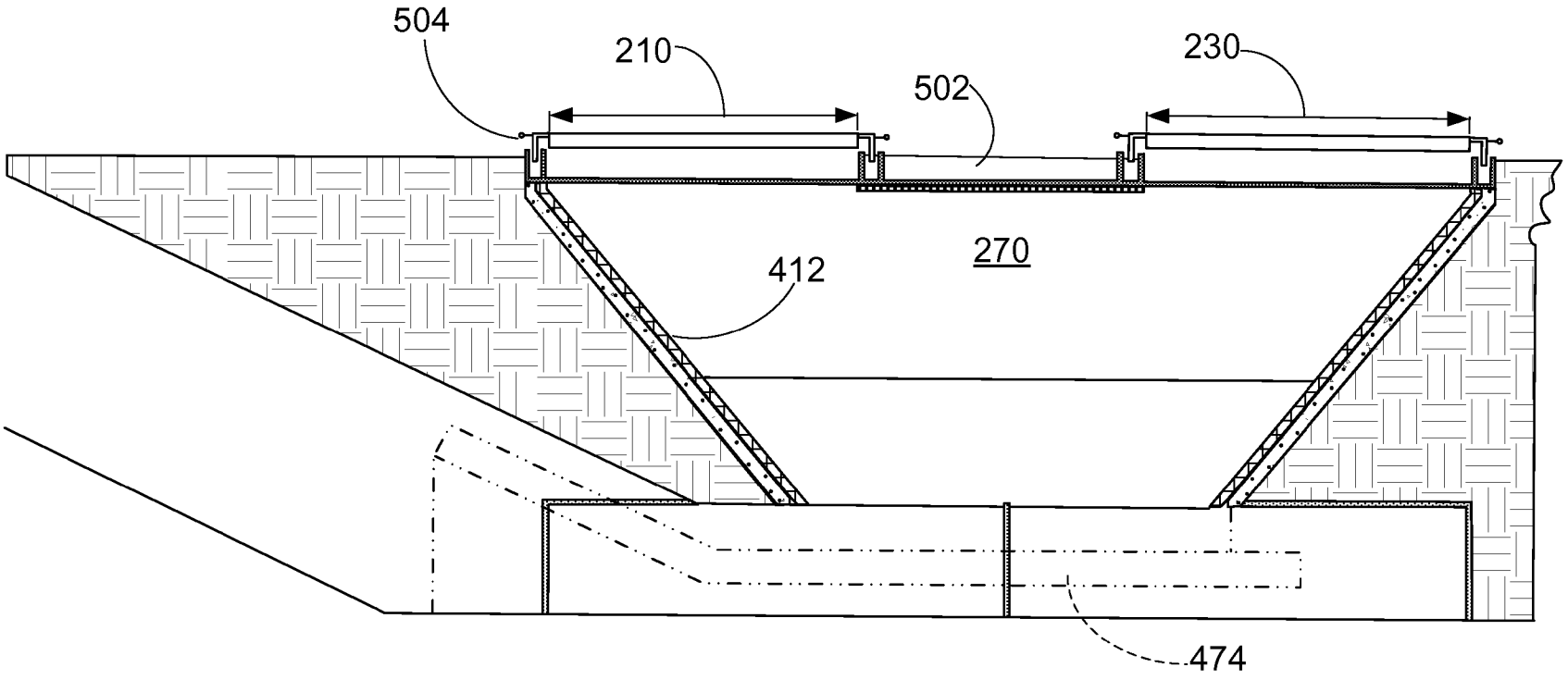
FIG. 7 is a side view of the hopper tunnel of FIG. 5.

FIGS. 5-7 are various views illustrating another possible variation on the structure of the hopper tunnel 270. The downdraft furnace enclosure 210 is on the left, and the convection pass enclosure 230 is on the right. The bottom of the hopper tunnel contains two submerged chain conveyors 474. The base 412 of the downdraft furnace enclosure is sloped to guide the ash/slag into the conveyors. In addition, a vertical wall 292 is located in the hopper tunnel between the two conveyors. The base 294 of the vertical wall is sloped laterally in both directions to guide the ash/slag into the conveyors. Arches 296 are present in the center of the hopper tunnel, and can be used to support the top tube panels 502 of the hopper tunnel. The vertical wall may have any desired length. Water trough seals 504 between the hopper tunnel, the downdraft furnace enclosure, and the convection pass enclosure are also visible. It is contemplated that ground level would be at the level of the water trough seals. The tunnel itself can be out of concrete, refractory, and dirt. Water cooling tube circuits can be placed in the walls and/or arches of the tunnel.

Referring specifically to FIG. 6, it should be noted that the base 294 of the vertical walls are sloped to create a funnel for the ash/slag, with the resulting opening 480 having a width 482 that is less than the width 484 of the submerged chain conveyor 486. The maintenance position for the conveyor is depicted here 488. It is contemplated that as needed for maintenance or other purposes, the conveyors can be switched out.

Because the furnace enclosure and the convection pass enclosure are designed to operate at a high temperature differential, the hopper tunnel 270 must be able to handle the transfer of very hot flue gas. The hopper tunnel may be lined with a refractory material 276, which is chemically and physically stable at high temperatures. Exemplary refractory materials include refractory brick containing aluminum oxide, silica, or magnesium oxide, or ceramic tiles. Such materials can withstand temperatures of 2800° F. to 3000° F. As illustrated here, the hopper tunnel has a width 282, refractory brick 276 located around the entire periphery of the tunnel, and insulation 278 surrounding the brick, and having the appropriate dimensions. The upper portion of the hopper tunnel has a height 284, and the lower portion of the hopper tunnel has a height 286. Present in the lower portion is a mechanical transport system 280 (e.g. a submerged chain conveyor) that moves the ash out of the hopper tunnel.

Figure 8:
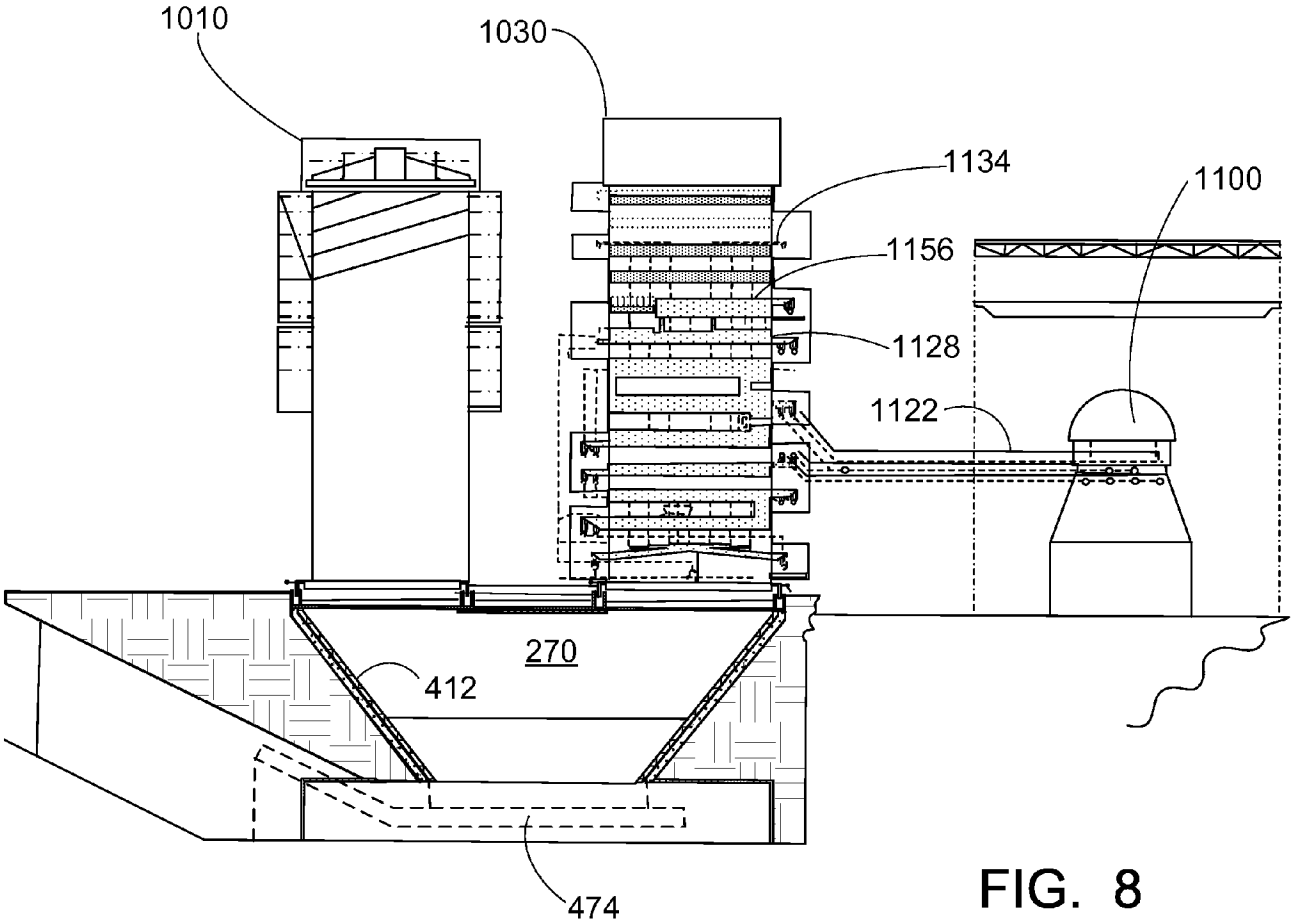
FIG. 8 is a side view of another exemplary embodiment of a downdraft inverted tower steam generator of the present disclosure, showing the steam turbine in relation to the steam generator.

FIG. 8 is a side view of an embodiment of the downdraft inverted tower steam generator and steam turbine. The downdraft furnace enclosure 1010 is on the left, and the convection pass enclosure 1030 is on the right. The steam turbine 1100 is on the far right. The solid lines 1122 represent the steam leads that carry the supercritical steam and/or reheat steam to the steam turbine. The dotted rectangles 1128 represent reheaters/superheaters. The rectangles 1156 represent economizers. The rectangle 1134 represents a separate low pressure steam generator to produce auxiliary steam for utility purposes. The hopper tunnel 270 is also shown here. Again, the base 412 is sloped longitudinally to direct ash/slag into the conveyors 474.

FIGS. 9-12 are various drawings showing another embodiment of a steam generator. This embodiment contains the downdraft furnace enclosure 1010, hopper tunnel 1070, and convection pass enclosure 1030, and also contains additional down pass 1092.

Figure 9:
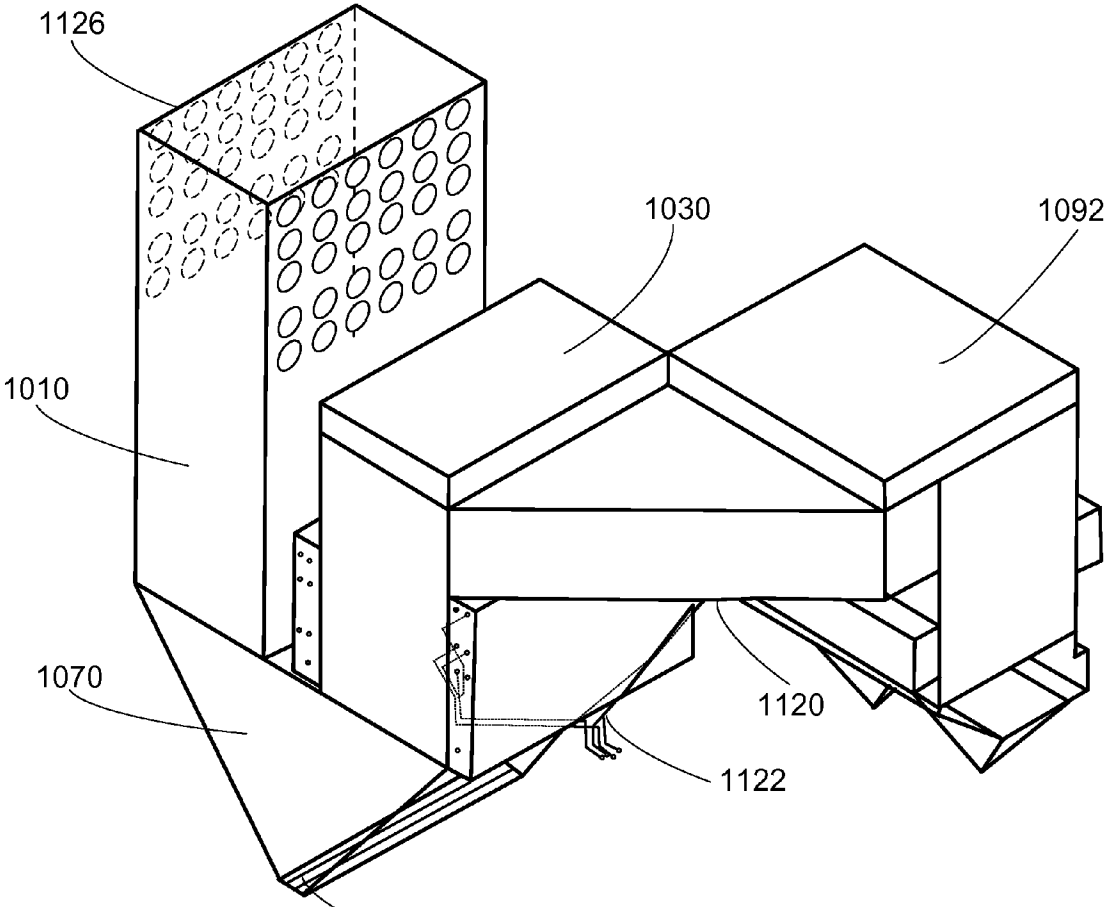
FIG. 9 is a perspective view of another embodiment of a downdraft inverted tower steam generator and the steam turbine piping.

FIG. 9 is a perspective view of the exterior of the steam generator. The downdraft furnace enclosure 1010 is on the far left, and the convection pass enclosure 1030 is in the center. The hopper tunnel 1070 is the triangular structure linking the base of the convection pass enclosure 1030 with the base of the downdraft furnace enclosure 1010. The down pass 1092 is the structure on the far right. The rectangle at the bottom of the hopper tunnel represents the chain conveyor 1074 that removes ash/slag. The solid lines 1122 represent the steam outlet piping. The circles 1126 represent burner openings at the top of the downdraft furnace enclosure. Reference numeral 1120 is the upper horizontal pass structure connecting the convection pass enclosure 1030 with the down pass 1092.

Figure 10:
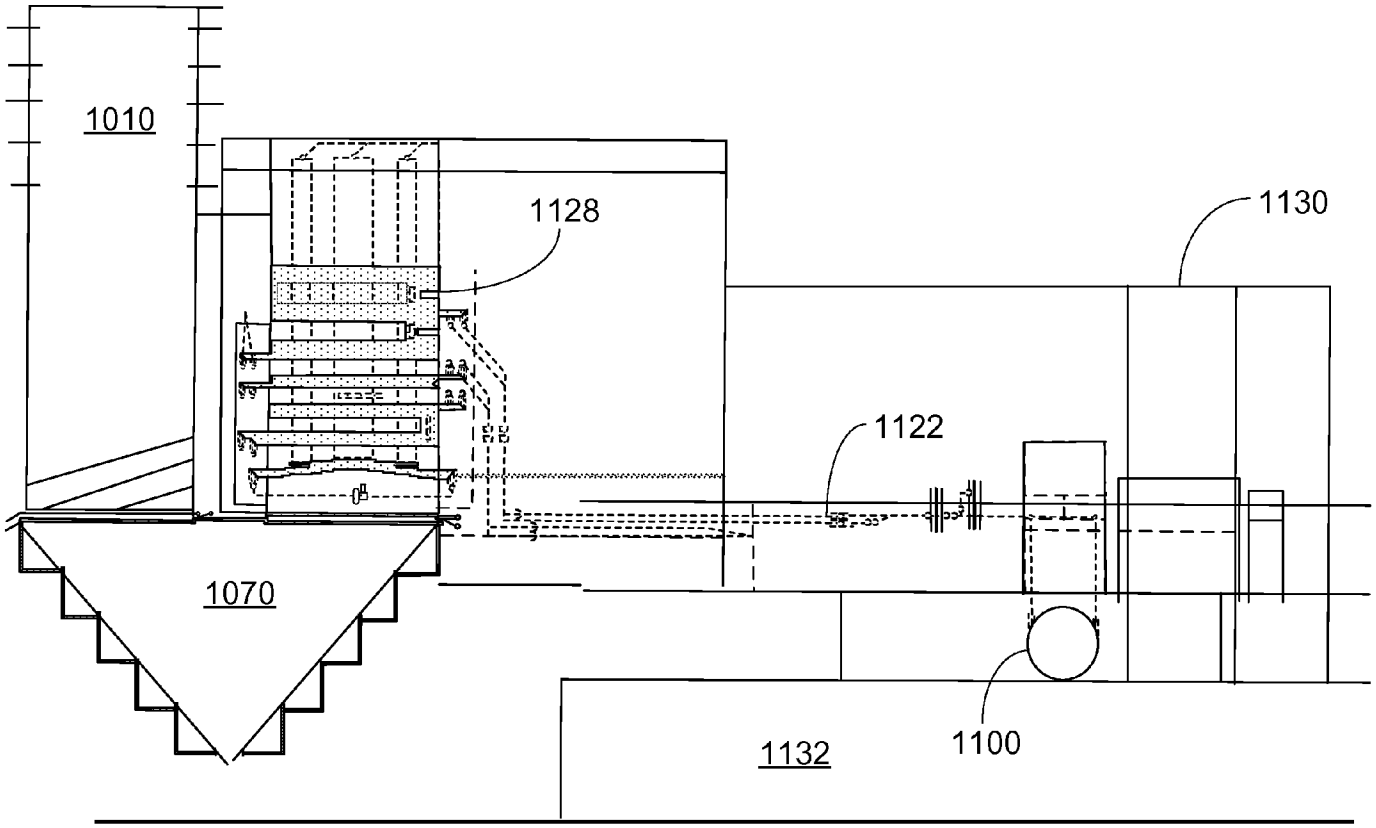
FIG. 10 is a side view (along an imaginary y-axis) of the steam generator of FIG. 9.

FIG. 10 is a side view (along an imaginary y-axis) of the steam generator and the steam turbine. The dotted rectangles 1128 represent the horizontal tube banks that serve as reheaters/superheaters, and provide the outlet steam terminals near the base of the steam generator/convection pass enclosure. The dashed lines 1122 represent the steam leads that carry the supercritical steam and/or reheat steam to the steam turbine. The steam turbine 1100 is contained in a building marked by reference numeral 1130. It should be noted that the steam turbine is located on elevation 1132, relative to the steam generator.

Figure 11:
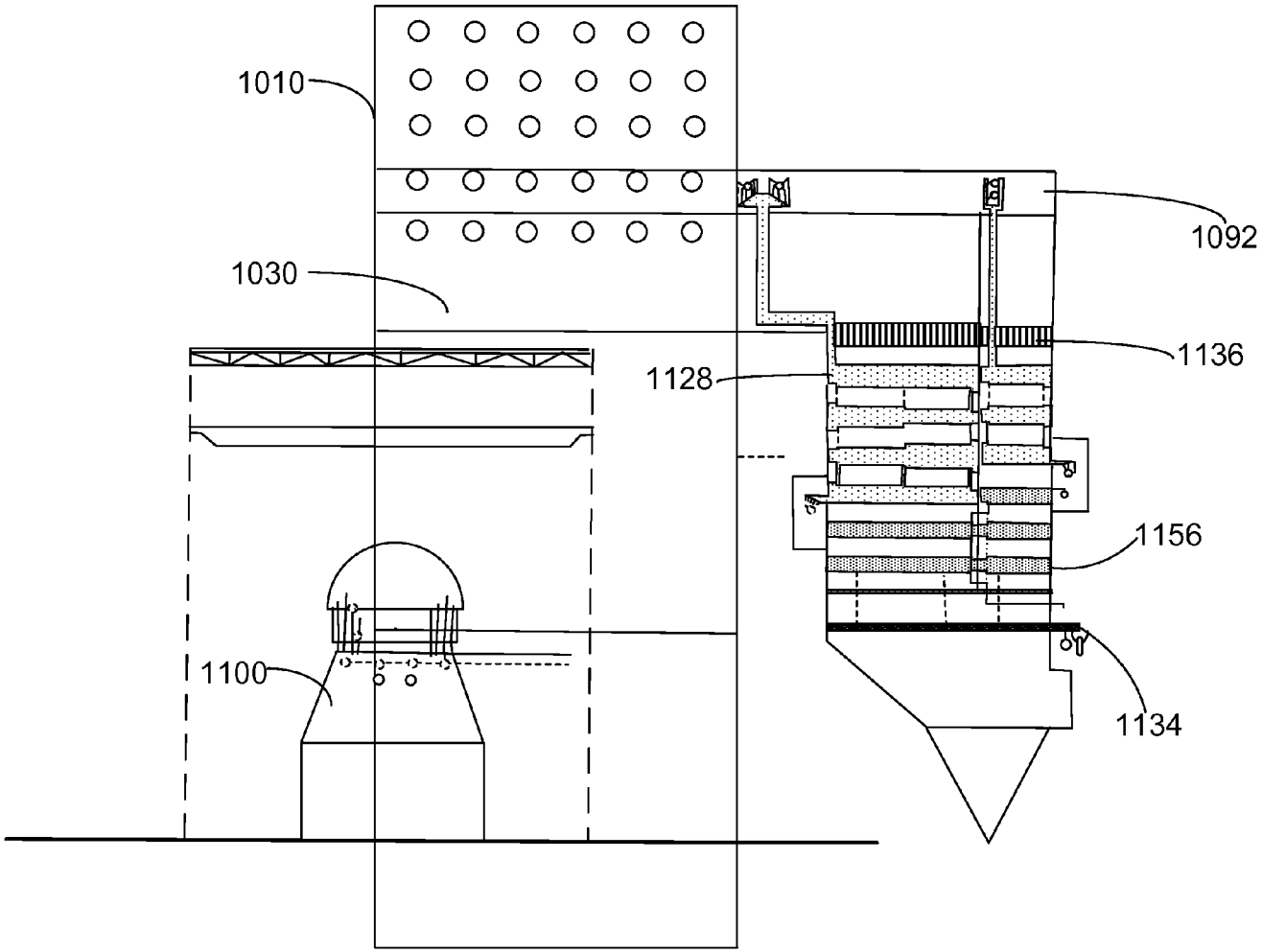
FIG. 11 is a front view (along an imaginary x-axis) of the steam generator of FIG. 9.

FIG. 11 is a front view (along an imaginary x-axis) of the steam generator and the steam turbine. The convection pass enclosure 1030 is not fully visible here, because it is behind the building containing the steam turbine. The additional down pass 1092 is seen on the right. Again, the dotted rectangles 1128 represent the reheaters/superheaters. The stippled rectangles 1156 represent horizontal tube banks that serve as economizers. The solid black rectangle 1134 represents a separate low pressure steam generator to produce auxiliary steam for utility purposes such as sootblowing. Using a lower temperature coolant helps reduce flue gas temperature and does not use super-elevated high temperature high pressure steam for lower level services. The striped rectangle 1136 represents a space for future heating surfaces to be installed (e.g. for modifications during the service life of the steam generator). The steam turbine is marked as reference numeral 1100.

Figure 12:
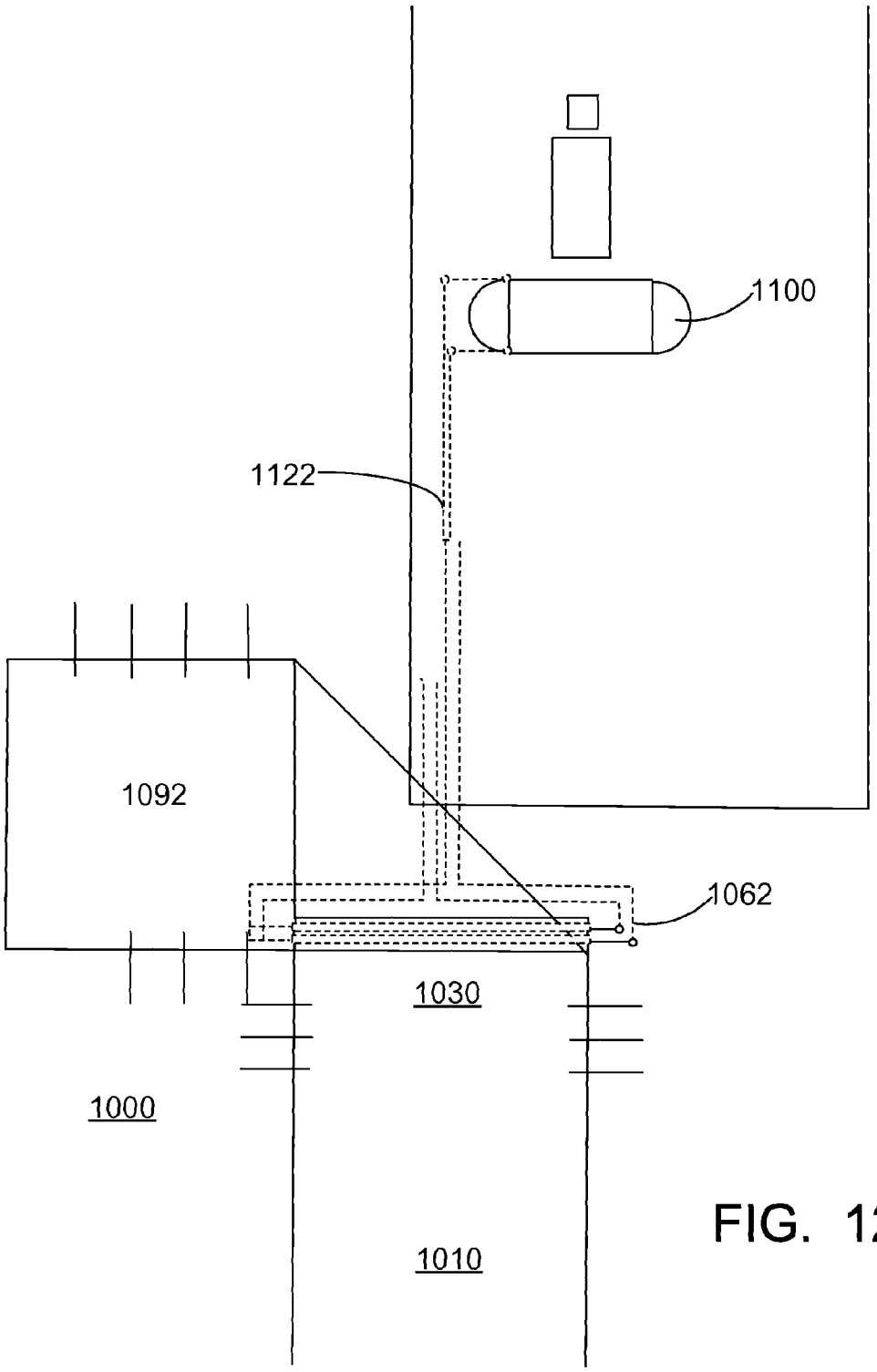
FIG. 12 is a plan view (i.e. from the top) of the steam generator of FIG. 9.

FIG. 12 is a plan view (i.e. from the top) of the steam generator 1000 and steam turbine 1100. As seen here, the lines 1122 illustrate the steam leads that feed the steam turbine. The steam leads run from the steam outlet terminals 1062 on the convection pass enclosure 1030 to multiple locations on the steam turbine.

Figure 13:
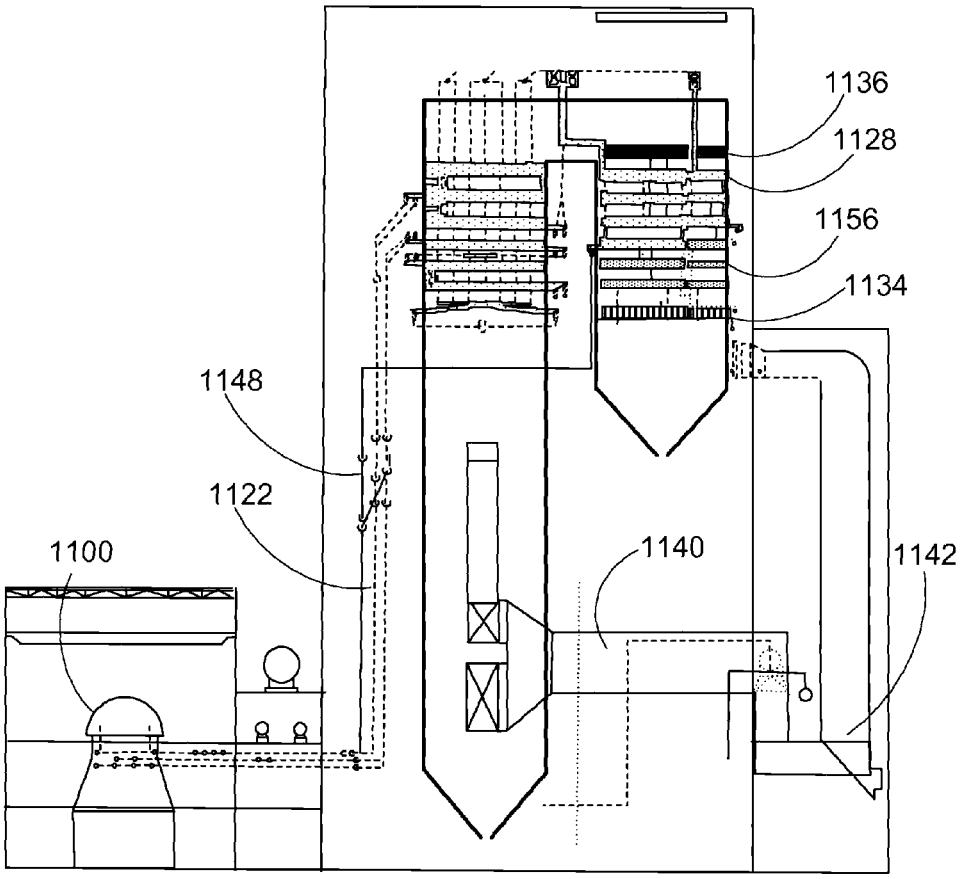
FIG. 13 is a side view showing the steam turbine at the same grade as the modified tower steam generator (i.e. in the conventionally expected relative position).

FIG. 13 is a side view (along an imaginary x-axis) of another embodiment of a modified tower steam generator and the steam turbine. The dotted rectangles 1128 represent reheaters/superheaters. The stippled rectangles 1156 represent economizers. The solid black rectangle 1134 represents a separate low pressure steam generator to produce auxiliary steam for utility purposes. The striped rectangle 1136 represents future heating surfaces. The secondary air duct 1140 leading from the regenerative air heater 1142 is also shown here. The dashed lines 1122 are the steam leads that feed the steam turbine 1100 with supercritical steam and/or reheat steam. The solid lines 1148 are feedwater and cold reheat steam lines from the feedwater heaters and the steam turbine.

Figure 14:
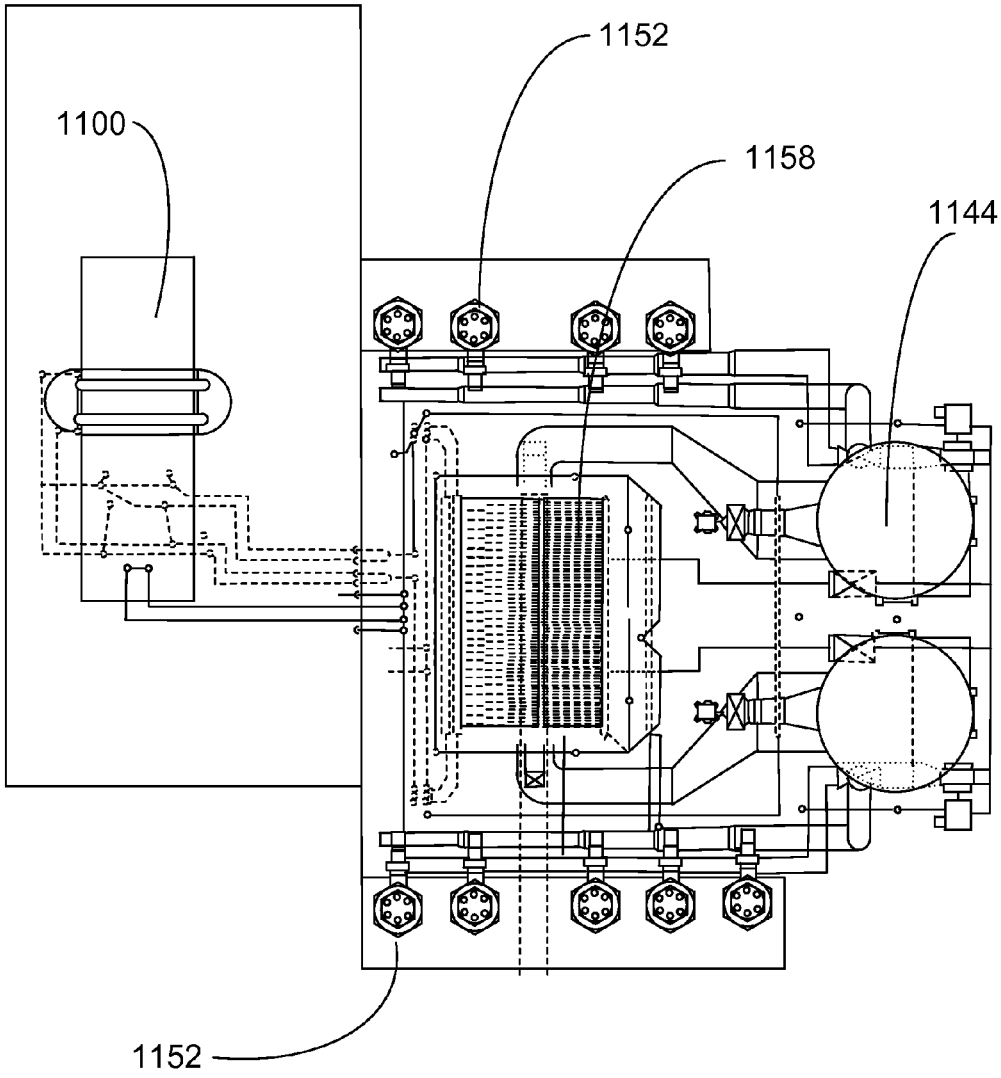
FIG. 14 is a plan view (i.e. from the top) showing additional details of the modified tower steam generator of FIG. 13.

FIG. 14 is a plan view (i.e. from the top) showing additional details of the modified tower steam generator. The lines 1158 in the middle represent convection heating surface. The two circles 1144 on the right-hand side represent regenerative air heaters. The nine hexagonal shaped structures 1152 represent coal pulverizers.

Figure 15:
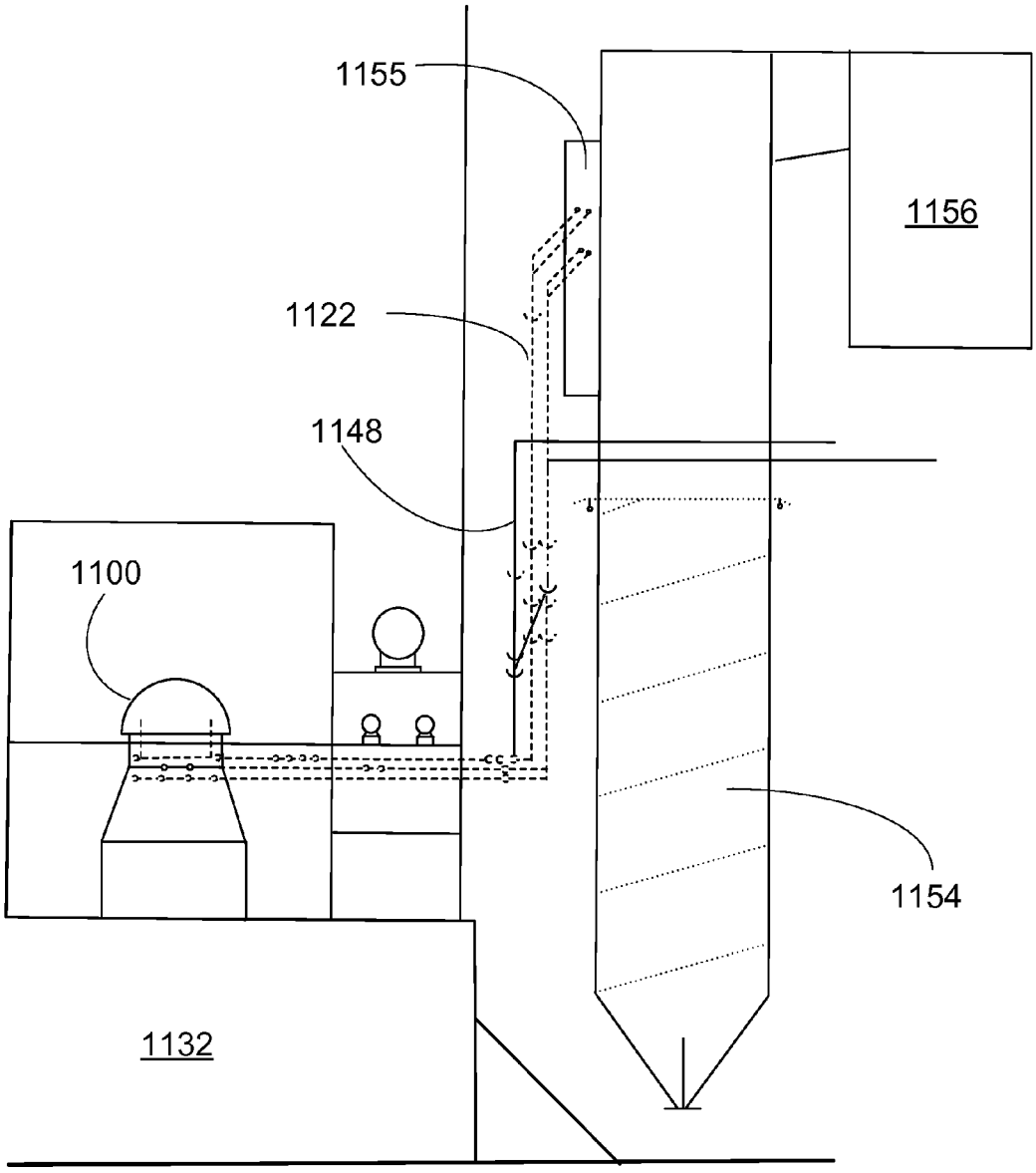
FIG. 15 is a side view of an embodiment where the modified tower steam generator has a base elevation difference compared to the steam turbine.
Figure 16:
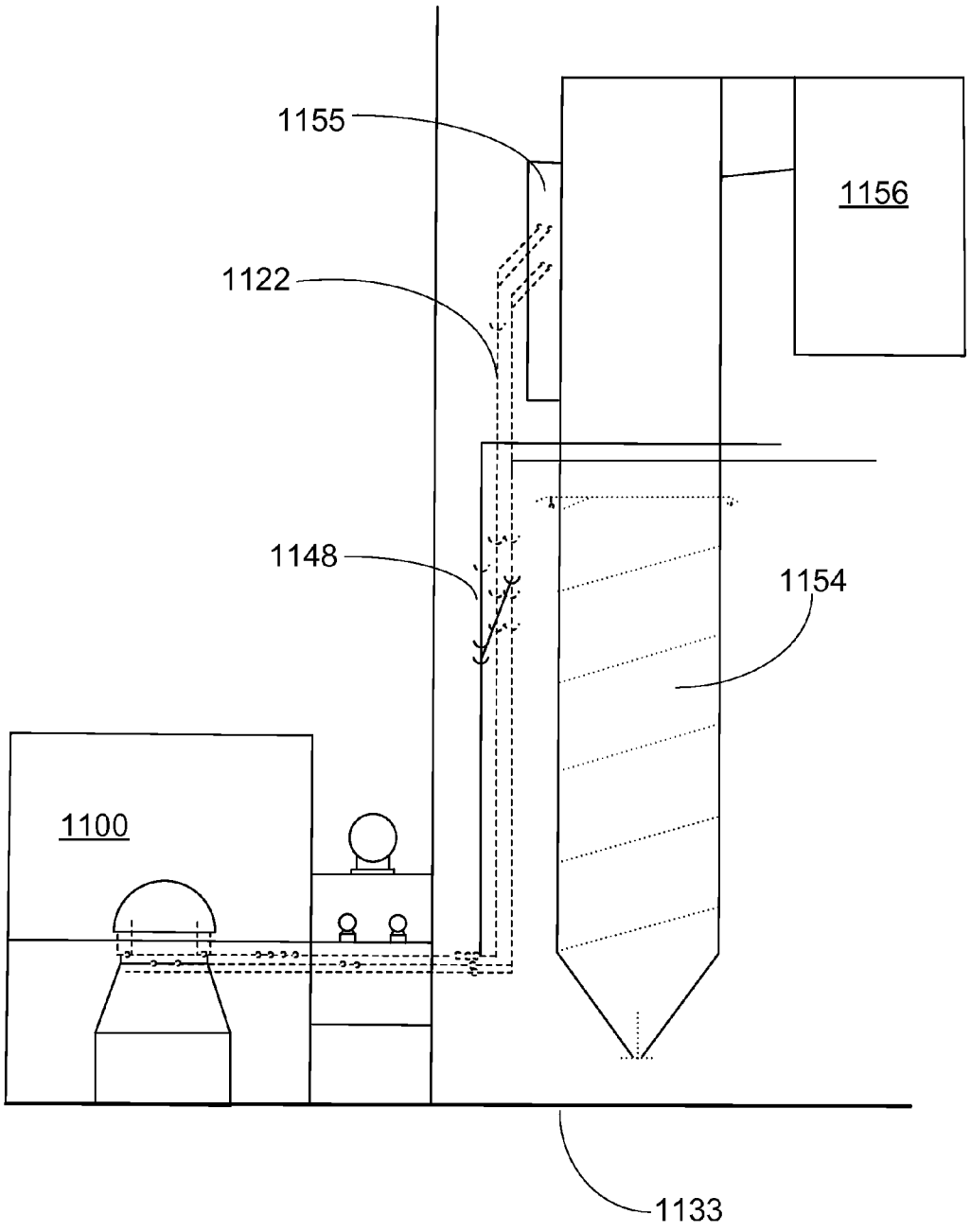
FIG. 16 is a side view of an embodiment where the modified tower steam generator has the same base elevation as the steam turbine.

FIG. 15 is a side view (along an imaginary x-axis) of the modified tower steam generator having a base elevation difference compared to the steam turbine 1100, which reduces steam line length. The structure 1154 in the center represents the furnace enclosure. The convection pass enclosure 1155 is above the furnace enclosure. The rectangle 1156 on the right represents the additional down pass downstream of the convection pass enclosure. The lines 1122 are the steam leads that feed the steam turbine 1100 with supercritical steam and/or reheat steam. The black lines 1148 are feedwater and cold reheat steam lines from the feedwater heaters and steam turbine. It should be noted that the black lines are run from the steam turbine to the horizontal convection pass enclosure, which is not completely visible here. Again, please note that the steam turbine is located on elevation 1132. FIG. 16 is similar to FIG. 15, except the steam turbine 1100 is located at the same elevation 1133 as the steam generator.

It is noted that the convection pass enclosure is depicted in the various Figures as having a single gas path. It is also contemplated that the convection pass enclosure can include parallel gas paths, where one gas path can be used for steam temperature control using gas biasing.

Figure 17:
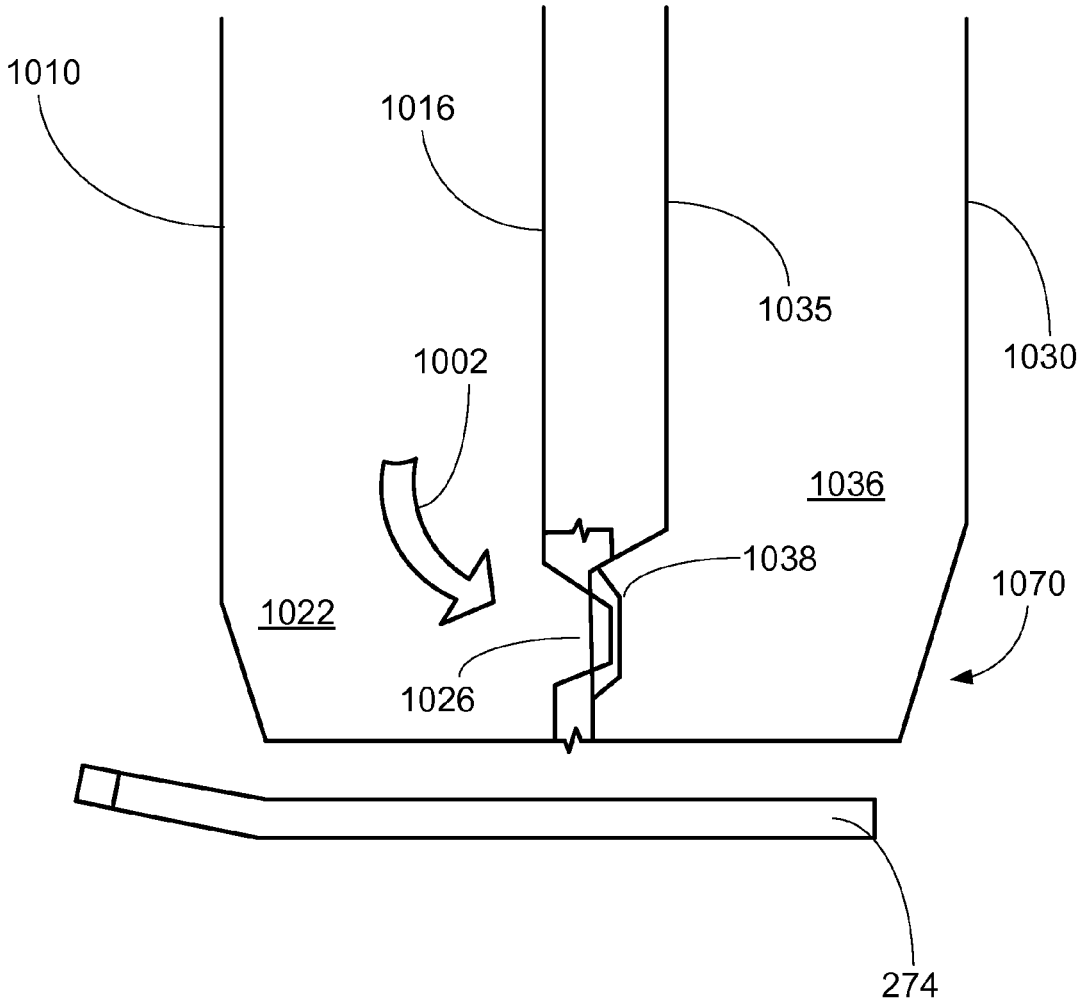
FIG. 17 is a side view of another exemplary embodiment of a steam generator of the present disclosure, wherein the bottom gas outlet of the downdraft furnace enclosure is shaped as a throat that enters a porthole of the bottom gas inlet of the convection pass enclosure.

FIG. 17 is a side view showing another embodiment of the downdraft inverted tower steam generator. This embodiment also includes a downdraft furnace enclosure 1010, a convection pass enclosure 1030, and a hopper tunnel 1070. As before, a bottom gas outlet is present at the bottom end of the downdraft furnace enclosure, and a bottom gas inlet is present at the bottom end of the convection pass enclosure. Here, the upper portion of the hopper tunnel is formed by the bottom ends of the downdraft furnace enclosure 1010 and the convection pass enclosure 1030. The bottom gas outlet 1022 of the downdraft furnace enclosure 1010 includes an outwardly extending nozzle that constricts in diameter as it extends from the walls 1016 of the flue tunnel to form a throat 1026. The bottom gas inlet 1036 of the convection pass enclosure 1030 includes an inward-facing porthole 1038. It is contemplated that the throat 1026 of the bottom gas outlet extends into the porthole 1038 of the bottom gas inlet to form a passageway through which the flue gas (arrow 1002) can flow from the downdraft furnace enclosure into the convection pass enclosure. It should be noted that the walls of the flue tunnel (1016) and the walls of the convection pass enclosure (1035) are not welded together. However, the flat vertical faces of the two enclosures are placed closely together to permit the use of flexible gas-tight sealing toggle connections. In addition, stanchion bracing (not shown) may be used to control the relative movement of the two enclosures that may occur. The downdraft furnace enclosure 1010 and the convection pass enclosure 1030 include an opening into the lower portion of the hopper tunnel, where the submerged chain conveyor 274 is located. The various banks (reheat, superheat, economizer) in the convection pass enclosure 1030 are not illustrated here.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A steam generator, comprising:

a downdraft furnace enclosure formed from walls made of water or steam cooled tubes, and wherein the furnace walls define a top end and a bottom gas outlet at a bottom end;

a windbox and burners at the top end of the downdraft furnace enclosure for generating flue gas;

a convection pass enclosure including a bottom gas inlet and horizontal tube banks located above the bottom gas inlet;

a hopper tunnel connecting the bottom gas outlet of the downdraft furnace enclosure to the bottom gas inlet of the convection pass enclosure, such that hot flue gas exits the downdraft furnace enclosure and then flows upwards through the convection pass enclosure; and a steam outlet terminal located at a base of the steam generator;

wherein flue gas exiting the convection pass enclosure is recirculated to one of:

the top end of the downdraft furnace enclosure;

a base of the downdraft furnace enclosure; or a base of the convection pass enclosure.

2. The steam generator of claim 1, wherein the top end of the downdraft furnace enclosure includes a gas inlet for receiving flue gas.

3. The steam generator of claim 1, wherein flue gas exiting the convection pass enclosure is recirculated to the top end of the downdraft furnace enclosure.

4. The steam generator of claim 1, wherein flue gas exiting the convection pass enclosure is recirculated to the base of the downdraft furnace enclosure.

5. The steam generator of claim 1, wherein flue gas exiting the convection pass enclosure is recirculated to the base of the convection pass enclosure.

6. The steam generator of claim 1, wherein the hopper tunnel is lined with a refractory material.

7. The steam generator of claim 1, wherein the hopper tunnel is formed from steam or water-cooled tube panels.

8. The steam generator of claim 7, wherein water trough seals are present between the downdraft furnace enclosure, the hopper tunnel, and the convection pass enclosure.

9. The steam generator of claim 1, wherein fluid in the tubes of the downdraft furnace enclosure flows counter-current to flue gas flow.

10. The steam generator of claim 1, wherein the convection pass enclosure is formed from enclosure walls made of steam or water cooled tubes, wherein the cooling fluid in the tubes of the convection pass enclosure flow co-current to flue gas flow.

11. The steam generator of claim 1, wherein the horizontal tube banks in the convection pass enclosure include superheaters, reheaters, and economizers.

12. The steam generator of claim 1, wherein the steam generator further comprises an upper horizontal pass enclosure connected to a top end of the convection pass enclosure and a down pass, the upper horizontal pass and the down pass containing additional tube banks.

13. The steam generator of claim 1, wherein the hopper tunnel includes a submerged chain conveyor for removing ash and slag.

14. The steam generator of claim 13, wherein the submerged chain conveyor travels in-line with the flue gas flow.

15. The steam generator of claim 13, wherein the submerged chain conveyor travels transverse to the flue gas flow.

16. A steam generator, comprising:

a downdraft furnace enclosure formed from walls made of water or steam cooled tubes, and wherein the furnace walls define a top end and a bottom gas outlet at a bottom end;

a windbox and burners at the top end of the downdraft furnace enclosure for generating flue gas;

a convection pass enclosure including a bottom gas inlet and horizontal tube banks located above the bottom gas inlet;

a hopper tunnel connecting the bottom gas outlet of the downdraft furnace enclosure to the bottom gas inlet of the convection pass enclosure, such that hot flue pas exits the downdraft furnace enclosure and then flows upwards through the convection pass enclosure; and a steam outlet terminal located at a base of the steam generator;

wherein flue gas exiting the convection pass enclosure passes through at least one of (a) a regenerative air heater and (b) a particulate cleaning device; and is then recirculated to the top end of the downdraft furnace enclosure, a base of the downdraft furnace enclosure, or a base of the convection pass enclosure.

17. The steam generator of claim 16, wherein flue gas exiting the convection pass enclosure passes through the particulate cleaning device and is then recirculated.

18. The steam generator of claim 16, wherein flue gas exiting the convection pass enclosure passes through the regenerative air heater and is then recirculated.

19. A steam generator, comprising:

a downdraft furnace enclosure formed from walls made of water or steam cooled tubes, and wherein the furnace walls define a top end and a bottom gas outlet at a bottom end;

a windbox and burners at the top end of the downdraft furnace enclosure for generating flue gas;

a convection pass enclosure including a bottom gas inlet and horizontal tube banks located above the bottom gas inlet;

a hopper tunnel connecting the bottom gas outlet of the downdraft furnace enclosure to the bottom gas inlet of the convection pass enclosure, such that hot flue gas exits the downdraft furnace enclosure and then flows upwards through the convection pass enclosure; and a steam outlet terminal located at a base of the steam generator;

wherein the hopper tunnel is formed by an outwardly-extending throat of the bottom gas outlet of the downdraft furnace enclosure that extends into a porthole of the bottom gas inlet of the convection pass enclosure.

* * * * *